US006251026B1

(12) United States Patent
Bonvillain

(10) Patent No.: US 6,251,026 B1
(45) Date of Patent: Jun. 26, 2001

(54) GOLF PUTTER

(76) Inventor: Jackie P. Bonvillain, 503 Oakwood Dr., Houma, LA (US) 70363

( * ) Notice: Subject to any disclaimer, the term of this patent is extended or adjusted under 35 U.S.C. 154(b) by 0 days.

(21) Appl. No.: 09/325,579

(22) Filed: Jun. 3, 1999

(51) Int. Cl.[7] ..... A63B 53/00
(52) U.S. Cl. ..... 473/268; 473/313; 473/314
(58) Field of Search ..... 473/313, 314, 473/340, 341, 294, 251, 252, 268, 266, 267

(56) References Cited

U.S. PATENT DOCUMENTS 2,204,974 * 6/1940 Strasser .
4,002,343 1/1977 Eckert .
4,252,317 * 2/1981 Vezina .
5,209,475 * 5/1993 Loman .
5,351,962 10/1994 Lin .
5,362,058 11/1994 Honig .
5,441,270 8/1995 Williams .
5,447,313 9/1995 Finley .
5,474,300 * 12/1995 Scalise .
5,595,385 1/1997 Jablonski .
5,672,117 * 9/1997 Dar .
5,746,662 * 5/1998 Squire .

* cited by examiner

*Primary Examiner*—Jeanette Chapman
*Assistant Examiner*—Stephen L. Blau
(74) *Attorney, Agent, or Firm*—Henderson & Sturm LLP

(57) ABSTRACT

A putter construction comprising a shaft attached at an angle to a club face. The shaft being provided with a grip having an angled end extension handle that is adapted to extend in a parallel orientation with the bottom of the club face. The handle is provided with a snap fitting at the tip end for holding a pencil that allows the user to use the pencil as an alignment pointer, and further includes an arrow alignment pointer on an under surface thereof that has a 180 degree range of rotation between two perpendicular orientations with the end portion of the handle.

5 Claims, 1 Drawing Sheet

GOLF PUTTER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the field of golfing equipment, and more particularly to a golf putter.

2. Description of the Related Art

As can be seen by reference to the following U.S. Pat. Nos. 4,002,343; 5,351,962; 5,362,058; 5,447,313; 5,441,270; and 5,595,385 the prior art is replete with myriad and diverse golf putters.

While all of the aforementioned prior art constructions are more than adequate for the basic purpose for which they have been specifically designed, they are uniformly deficient with respect to their failure to provide a simple, efficient and practical golf putter.

As a consequence of the foregoing situation, there has existed a need for a new and improved golf putter and the provision of such a construction is a stated objective of the present invention.

BRIEF SUMMARY OF THE INVENTION

Briefly stated, the present invention provides a putter construction comprising a shaft attached at an angle to a club face. The shaft being provided with a grip having an angled end extension handle that is adapted to extend in a parallel orientation with the bottom of the club face. The handle is provided with a snap fitting at the tip end for holding a pencil that allows the user to use the pencil as an alignment pointer, and further includes an arrow alignment pointer on an under surface thereof that has a 180 degree range of rotation between two perpendicular orientations with the end portion of the handle.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
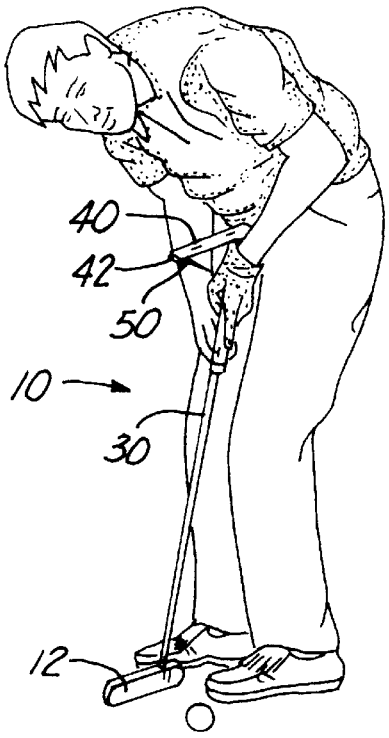
FIG. 1 is a perspective view of a golfer using the golf putter of the present invention.
Figure 2:
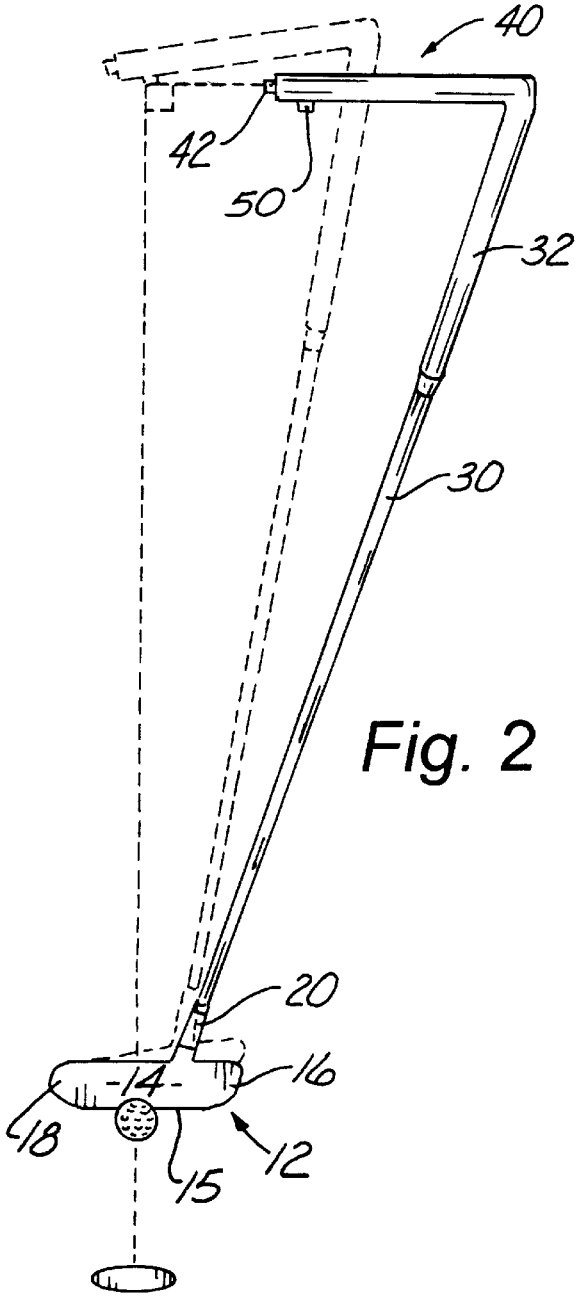
FIG. 2 is a front elevational view of the golf putter with a dashed line illustration of the putter positioned to align the putt, and a fall line illustration of the putter positioned to address the ball.

As can be seen by reference to the drawings, and in particulary to FIG. 1, the golf putter that forms the basis for part of the present invention is designated generally by reference number (10). As best shown in FIG. 2, the putter (10) includes a putter head (12) fabricated of brass on some other suitable material. The putter head (12) has a club face (14) with a bottom edge (15), a heel (16), a toe (18), and a neck (20) for attachment to a high-quality aluminum shaft (30). The shaft (30) may be formed of any of a number of materials suitable for use in a standard high-quality walking cane.

The upper part of the shaft (30) carries a grip (32) covered with an elastomer or other non-slip material. A handle extension (40) extends from the top of the shaft (30) at an angle such that the handle (40) is disposed substantially parallel to the bottom edge (15) of the club face (14). The handle (40) is also covered with a suitable non-slip material. The handle (40) may be an integrally formed extension of the shaft (30), or a separate attachment for existing putters.

Figure 3:
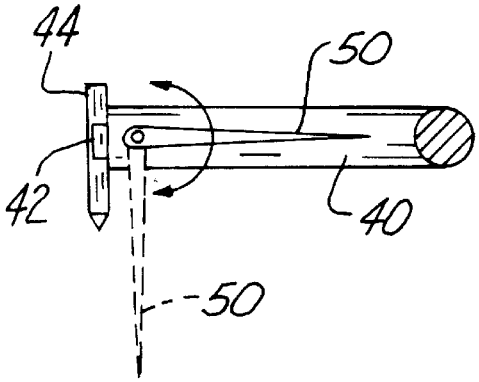
FIG. 3 is a bottom view of the handle extension with the alignment pointer shown in dashed line positioned perpendicular to the handle to align the putt.

The distal end of the handle (40) carries a clip (42) adapted to frictionally engage a pencil (44) and secure it in a position pointing perpendicular to the handle (40). Also, as shown in FIG. 3, the underside of the handle (40) near the distal end carries an arrow pointer (50). The pointer (50) is selectively movable from the closed position parallel to the handle (40), to an open position directed perpendicular to the handle (40). The pointer (50) may be positioned at 180° from the position shown in dashed lines in FIG. 3 to accommodate a left-handed player. The putter (10) functions as a walking cane with an incorporated golf putting head (12) at the bottom, allowing the user to use the device for walking, but more importantly it is a most dramatic change in putter design. It gives the player not only just two points of view (eye and putter blade) to line up the putt, it gives an intermediate point of view of the top of the handle (40) with a pointer (50) to line up the putt. The putter (10) would be a great gag gift for birthdays (such as turning 50), Christmas, anniversary, service award, or for a job well done. Also it is an ideal serious gift for the senior golfer, or any golfer who has difficulty walking to and from the green due to physical disabilities. But especially for any golfer who wants to improve their putting because it gives a third point of view to line up the putt. This new putter (10) could be used by both professional and amateur players alike. It would be attractive to both male and female players as it would drastically improve their games. It would make lining up a putt easier since a pointer (50) under the handle (40) swings out to either side for a right or left handed player. It also has a plastic snap or clip (42) to hold a scoring pencil (44) as a pointer if one chooses not to use the swing out pointer (50) under the handle (40). Snapping the pointer (50) back under the handle (40) will protect it from getting broken while putting it in or out of the golf bag. It would also make it easier for the handicapped player to walk back and forth from the cart to the green and it would extend the number of years an older person could play golf.

The pencil (44) or arrow pointer (50) can be used to determine the proper line of sight. The arrow pointer (50) can rotate 90 degrees to the right or left depending on which hand the player uses. The arrow pointer (50) when in its open position gives the putter the best line of sight. The player assumes a normal putting stance, then moves the top of the handle (40) until the pointer (50) is directly over the center of the putter head (12), giving the player a 90 degree right angle view of the direct line of sight (FIG. 2, dashed line). Then once he visualizes his line, he pulls the handle (40) back towards his body to the normal stance and proceeds to putt (FIG. 2, full line). The design allows the putter (10) to be fully functional as a golf putter and walking cane.

In use, the user simply carries the putter (10) along in their cart while golfing. When the ball is on the putting green, they use the putter (10) as a cane to assist them in walking to the ball. They then utilize the device as a putter to hit the ball into the hole. At this time, they would again enjoy the benefit of having the use of a cane while walking back to the cart. Use of the putter (10) provides a very practical and easy to use method of allowing one who may be elderly, handicapped, or otherwise physically debilitated, a means of gaining more enjoyment from the game of golf, as they would be able to get to and from the green in a far easier and safer manner.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A golf putter, comprising:

a putter head having a club face with a bottom edge;

a shaft attached to the putter head and extending upwardly therefrom;

a grip attached to a top portion of the shaft;

a handle attached to the top portion of the shaft above the grip and being disposed to extend substantially parallel to the bottom edge of the club face terminating in a free end; and an alignment device attached to the handle adjacent the free end, the alignment device including a member directed perpendicular to the handle and perpendicular to the club face, wherein the alignment device Includes a clip attached to the free end of the handle and disposed to frictionally engage and Secure a pencil directed perpendicular to the handle.

2. The golf putter of claim 1 wherein the alignment device includes a movable pointer pivotally attached to the handle, the pointer being selectively movable between a storage position disposed parallel to the handle to a sighting position disposed perpendicular to the handle.

3. The golf putter of claim 2 wherein the pointer is attached to an underside of the handle adjacent the free end.

4. The golf putter of claim 3 wherein the pointer is selectively movable to sighting positions at 90° either side of the storage position, whereby the pointer may be used by both right and left-handed players.

5. The golf putter of claim 1 wherein the handle is covered with a non-slip material.

* * * * *